US006498433B1

(12) United States Patent
Scott et al.

(10) Patent No.: US 6,498,433 B1
(45) Date of Patent: Dec. 24, 2002

(54) HIGH TEMPERATURE GLAZE FOR METAL HALIDE ARCTUBES

(75) Inventors: Curtis Edward Scott, Mentor, OH (US); Mary Sue Kaliszewski, Lyndhurst, OH (US); Paul George Mathews, Chesterland, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/475,700

(22) Filed: Dec. 30, 1999

(51) Int. Cl.[7] ..... H01J 17/16
(52) U.S. Cl. ..... 313/636; 313/635
(58) Field of Search ..... 313/493, 540, 313/635, 636, 110, 112

(56) References Cited

U.S. PATENT DOCUMENTS

| | | | | |
|---|---|---|---|---|
| 1,968,822 A | | 8/1934 | Gaidies et al. | |
| 3,851,200 A | * | 11/1974 | Thomasson | 313/113 |
| 4,047,067 A | | 9/1977 | Clausen | |
| 4,395,653 A | | 7/1983 | Graff | |
| 4,910,431 A | | 3/1990 | Witt et al. | |
| 5,032,757 A | | 7/1991 | Witting | |
| 5,032,762 A | | 7/1991 | Spacil et al. | |
| 5,039,912 A | | 8/1991 | Van Vilet et al. | |
| 5,270,615 A | | 12/1993 | Chang | |

FOREIGN PATENT DOCUMENTS

| | | |
|---|---|---|
| GB | 1130321 | 1/1966 |
| JP | 018965 | 2/1978 |

* cited by examiner

*Primary Examiner*—Vip Patel
(74) *Attorney, Agent, or Firm*—Fay, Sharpe, Fagan, Minnich & McKee, LLP

(57) ABSTRACT

An arc discharge lamp, such as a metal halide arc discharge lamp, has an extended life by reducing loss of the metallic portion of the fill. At least one component of the fill reacts with fused silica in the arc tube or diffuses through the arc tube walls. The fill will generally comprise a sodium halide, at least one additional metal halide, and an inert starting gas. A borosilicate glaze which is vitreous and light-transmissive is provided on the wall of the arc tube. The borosilicate glaze is comprised of a borosilicate glass containing at least one metal oxide selected from aluminum, scandium, yttrium, and the rare earth elements. The borosilicate glaze may further contain additional rare earth elements or transition metals to alter the light or energy emission of the lamp by absorbing select wave lengths. For instance, titanium, ceria, cobalt, chromium, iron or neodymium, or combinations of the foregoing, may be added.

20 Claims, 2 Drawing Sheets

HIGH TEMPERATURE GLAZE FOR METAL HALIDE ARCTUBES

BACKGROUND OF THE INVENTION

The present invention relates generally to high-intensity, metal halide arc discharge lamps having fused silica arc tubes filled with a mixture including sodium halides and at least one additional metal halide, and optionally mercury. More particularly, it relates to a borosilicate glaze present on the inner surface of the arc tube, the outer surface of the arc tube, or both the inner surface and the outer surface of the arc tube, for extending the useful life of the lamp by reducing the loss of the metallic portion of the fill and the corresponding undesirable buildup of free halogen in the arc tube which results from sodium ion diffusion through the fused silica arc tube or metal halide reaction with the fused silica arc tube.

Metal halide arc discharge lamps having a construction typical of this type of lamp are shown, for example, in U.S. Pat. Nos. 4,047,067 and 4,918,352 (electroded), and 5,032,762 (electrodeless). Metal halide lamps of this type generally contain a filling of light emitting metals including sodium and rare earth elements in the form of halides, commonly the iodide, and optionally mercury, in arc tubes composed of, for example, fused silica, alumina, and crystalline synthetic sapphire.

The lifetime of such lamps is frequently limited, however, by the loss of the metallic portion of the metal halide fill during lamp operation due to sodium ion diffusion and/or reaction of the metal halides with the fused silica arc tube and the corresponding buildup of free halogen in the arc tube. The term "free halogen" as used herein refers to volatile forms of halogens or halogen containing molecules created in the normal operating lamp as a result of sodium ion diffusion through the arc tube wall or metal halide reaction with the fused silica arc tube. Such resulting free halogen products could include iodine gas ($I_2$) or silicon tetra iodide ($SiI_4$), respectively.

The mobility of the sodium ion is such that the arc tubes are somewhat permeable to it. During lamp operation, sodium will diffuse through the arc tube wall to the cooler region between the arc tube and the outer jacket of the lamp and deposit on the outer jacket and on arc tube support structure where present. The lost sodium is thus unavailable to the discharge and can no longer contribute its characteristic emission so that the light output gradually diminishes and the color shifts from white toward blue. The arc becomes constricted as sodium is lost and, in a horizontally operating lamp particularly, may bow against the arc tube wall causing it to soften, leading eventually to non-passive failure. Also, loss of sodium causes the operating voltage of the lamp to increase, often rising to the point where the arc can no longer be sustained, ending the life of the lamp.

An additional source of loss of the metallic portion of the fill and corresponding buildup of free halogen during lamp operation is the chemical reaction of metal halides in the fill with the silicon dioxide, $SiO_2$, of the inner surface of the fused silica arc tube producing, for example, metal silicate crystals on the arc tube wall and free silicon tetra iodide. This results in a color shift in the lamp, arc tube wall darkening and/or cracking, plus lumen loss.

Thus, the industry has been searching for ways to prevent or minimize sodium loss by diffusion through the fused silica arc tubes of metal halide arc discharge lamps, as well as to reduce or prevent reactions of the ionizable, light-emitting metal halide species in the fill with the fused silica walls of the arc tubes. Attempts to solve these problems have included providing aluminum silicate and titanium silicate layers on the outside surface of the arc tube, as in U.S. Pat. Nos. 4,047,067 and 4,017,163, respectively. U.S. Reissue Pat. No. 30,165 discloses vitreous metal phosphates and arsenates as coatings for the inner surfaces of ceramic and silica arc tubes. U.S. Pat. No. 3,984,590 discloses aluminum phosphates and U.S. Pat. No. 5,032,762 discloses beryllium oxide as coatings for the inner surfaces of arc tubes.

Despite the coating advances of the prior art, the problems of loss of the light-emitting, metal halide portion of the fill by diffusion or reaction and the corresponding buildup of free halogen in the arc tube have not been heretofore satisfactorily solved.

Accordingly, the present invention provides a means for reducing loss of the metallic portion of the fill of an arc tube of a metal halide arc discharge lamp as a result of diffusion and/or reaction and hence provide a means for reducing the corresponding buildup of free halogen, thereby extending the useful life of the lamp.

This invention also provides a means to decrease UV emissions from the lamp by providing a glaze containing a UV absorbing species.

The present invention further provides a means to alter light or energy emission from the lamp by absorbing select wavelengths, i.e. UV or IR.

The present invention is directed to an improved arc tube and an improved metal halide discharge lamp including the improved arc tube having the aforesaid means.

BRIEF SUMMARY OF THE INVENTION

The present invention is an improved arc tube of fused silica for an arc discharge lamp. Such an arc discharge lamp could be a metal halide arc discharge lamp, including a fill for the arc tube capable of initiating and sustaining an electric arc discharge, wherein at least one component of the fill reacts with the fused silica or diffuses through the arc tube walls. The fill will generally comprise a sodium halide, at least one additional metal halide, and an inert starting gas. The improved arc tube will generally comprise a tube of fused silica having an inner wall defining an arc chamber, the inner wall, the outer wall, or the outer and inner walls, of the tube having provided thereon a borosilicate glaze which is vitreous and light-transmissive. The borosilicate glaze is comprised of a borosilicate glass containing at least one metal oxide selected from aluminum, scandium, yttrium, and the rare earth elements. The borosilicate glaze may further contain additional rare earth elements or transition metals to alter the light or energy emission of the lamp by absorbing select wave lengths. For instance, titanium, cerium, cobalt, chromium, iron or neodymium may be added. Of course, combinations of the foregoing may also be added to obtain desired emissions. The borosilicate glaze has been found to effectively extend the useful life of metal halide arc discharge lamps by reducing loss of the metallic portion of the fill through diffusion and/or reaction, and thus reducing the corresponding buildup of free halogen. In a broader sense, the invention relates to a fused silica article having a glaze of such borosilicate on at least a portion of a surface thereof.

The present invention additionally provides a metal halide arc discharge lamp assembly, having an arc tube of fused silica for containing a plasma arc discharge, and having a borosilicate glaze provided on the inner surface, the outer surface, or both the inner surface and the outer surface of the arc tube, the borosilicate glaze being vitreous and light-transmissive, and being comprised of a borosilicate containing at least one metal selected from aluminum, scandium, yttrium, and the rare earth elements. The borosilicate glaze may further contain additional rare earth elements or transition metals to alter the light or energy emission of the lamp by absorbing select wave lengths. For instance, titanium, cerium, cobalt, chromium, iron or neodymium may be added. Of course, combinations of the foregoing may also be added to obtain desired emissions. As obvious to those skilled in the art, such a borosilicate glaze would improve the arc tube in both an electroded metal halide arc discharge lamp and a high intensity discharge electrodeless lamp which operates by radio or microwave frequency.

The present invention additionally provides the process of protecting a fused silica arc tube of a metal halide arc discharge lamp, the lamp containing a fill including sodium halide, at least one additional metal halide, and an inert starting gas disposed within the arc tube from loss of the metallic portion of the fill through diffusion and/or reaction, and a corresponding buildup of free halogen in the arc tube. The process comprises providing the inner surface, the outer surface, or both the inner surface and the outer surface of the arc tube with a borosilicate glaze which is vitreous and light-transmissive, and which is comprised of a borosilicate containing at least one metal selected from the group consisting essentially of aluminum, scandium, yttrium, and the rare earth elements. The borosilicate glaze may further contain additional rare earth elements or transition metals to alter the light or energy emission of the lamp by absorbing select wavelengths. For instance, titanium, cerium, cobalt, chromium, iron or neodymium may be added. Of course, combinations of the foregoing may also be added specific to desired emissions.

BRIEF DESCRIPTION OF THE DRAWINGS

The features and advantages of the present invention will become apparent from the following detailed description of the invention when read with the accompanying drawings.

DETAILED DESCRIPTION OF THE INVENTION

Figure 1:
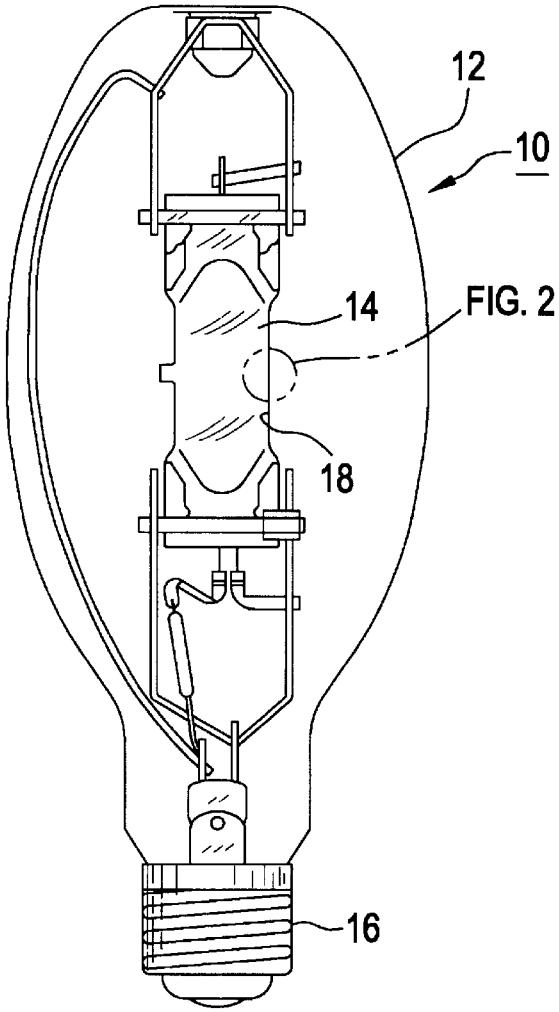
FIG. 1 illustrates a high intensity, metal halide discharge lamp employing a borosilicate glaze on the interior surface of the arc tube in keeping with the present invention.

The "borosilicate glaze" of the present invention is, in fact, a light-transmissive, glassy coating on the inner wall, the outer wall, or the inner wall and the outer wall of the fused silica arc tube. As used herein, the term "surface" or "arc tube surface" is meant to include the inner arc tube surface, the outer arc tube surface, or both the inner and outer arc tube surfaces. The glaze comprises a borosilicate formed from a high silica base glass, i.e. $SiO_2$, and $B_2O_3$. Also, the glaze further contains the oxide of a metal contained in the fill which would react with the $SiO_2$ of the fused silica arc tube in the absence of the glaze, for example, an oxide of aluminum, scandium, yttrium, a rare earth element, a transition metal, or mixtures thereof In particular, the glaze is vitreous, i.e., amorphous, is preferably substantially continuous, and preferably has a thickness sufficient to reduce sodium loss from the metal halide fill and/or reduce reaction of the metal species in the fill contained in the arc tube with the $SiO_2$ of the arc tube wall, and hence reduce the corresponding buildup of free halogen from these sources, thereby extending the useful life of the lamp. Furthermore, the glaze is sufficiently thin so as to allow only minimal blockage of visible light output from the arc tube. Generally, the thickness ranges between about 0.5 to about 100 $\mu$m. While it is not essential, it is preferable that the metal oxide component of the borosilicate glaze correspond to the metal component of the fill in the arc tube. Most preferably, the borosilicate glaze is comprised of a borosilicate containing the metal oxide(s) of the metal component(s) of the fill which are most reactive with the fused silica. Thus, for example, when the fill includes scandium iodide, the borosilicate coating preferably contains scandium oxide. The reaction product on the surface of a scandium iodide-containing lamp is scandium oxide. By providing a scandium oxide coating, the reaction product is already on the lamp surface, thus inhibiting reaction of the metallic fill with the quartz wall and, therefore, maintaining the fill to function as fill, i.e. extending lamp life. However, if the coating is placed on the outside surface of the lamp, where reaction between the metallic fill and coating metal oxide is unlikely, it is unnecessary to achieve compatibility and a more economically feasible coating material, such a alumina, may be used. Finally, if both inner and outer lamp surfaces are coated, the coatings need not be the same.

The borosilicate glaze preferably exhibits a coefficient of thermal expansion compatible with that of the arc tube. This is accomplished due to the low coefficient of thermal expansion of this high silica base glass as well as the refractory nature thereof. The thermal expansion compatibility of the glaze with the arc tube enhances adhesion of the glaze, reducing the tendency thereof to spall, chip or flake from the arc tube surface during use, thus exposing potential diffusion and/or reaction cites.

Preferably the borosilicate glaze has a thickness sufficient to reduce loss of the metallic portion of the fill by diffusion or reaction and a corresponding buildup of free halogen in the arc tube. Most preferably, the borosilicate glaze has a thickness ranging from about 0.5 to about 100, but more preferably, 25–50 micrometers. Most preferably, the borosilicate glaze is continuous.

The arc tube is made of fused silica, i.e., a vitreous, light-transmissive material containing at least 95 weight % $SiO_2$. As used herein, fused silica materials include fused quartz materials made by fusing naturally occurring quartz sand, as is known to those skilled in the art, as well as synthetic non-crystalline quartz and VYCOR. The lamp is filled with a fill including sodium halide and the halide of at least one additionally ionizable, light-emitting metal, such as scandium, yttrium or a rare earth, as is known to those skilled in the art, along with an inert starting gas, such as xenon and argon.

FIG. 1 is a schematic view of an illustrative but non-limiting embodiment of an electroded metal halide arc discharge lamp disclosed in U.S. Pat. No. 4,918,352 and useful in the practice of the present invention. Lamp 10 includes an outer envelope 12, made of a light-transmissive vitreous material, such as glass, a light-transmissive arc tube 14 made of light transmissive, fused silica, and a base 16 having suitable electrical contacts for making electrical connection to the arc tube. The remaining electrical components of such a lamp are known to the skilled artisan and as such need not be described further herein. While FIG. 1 shows an electroded lamp, the invention may additionally be practiced on an electrodeless metal halide arc discharge lamp as is known from, for example, U.S. Pat. No. 5,032,762.

Figure 2:
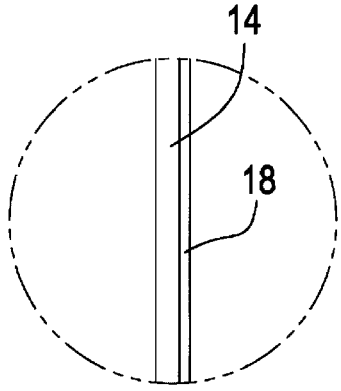
FIG. 2 illustrates a high intensity, metal halide discharge lamp employing a borosilicate glaze on the exterior surface of the arc tube in keeping with the present invention.
Figure 3:
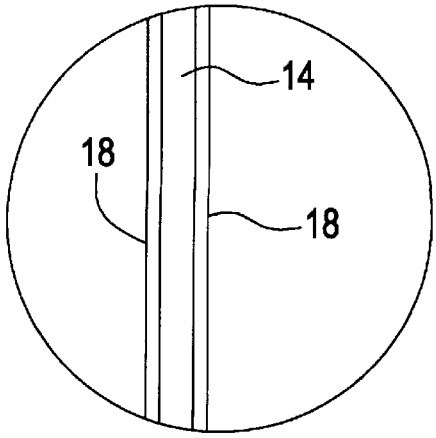
FIG. 3 illustrates a high intensity, metal halide discharge lamp employing a borosilicate glaze on the interior and exterior surfaces of the arc tube in keeping with the present invention.
Figure 4:
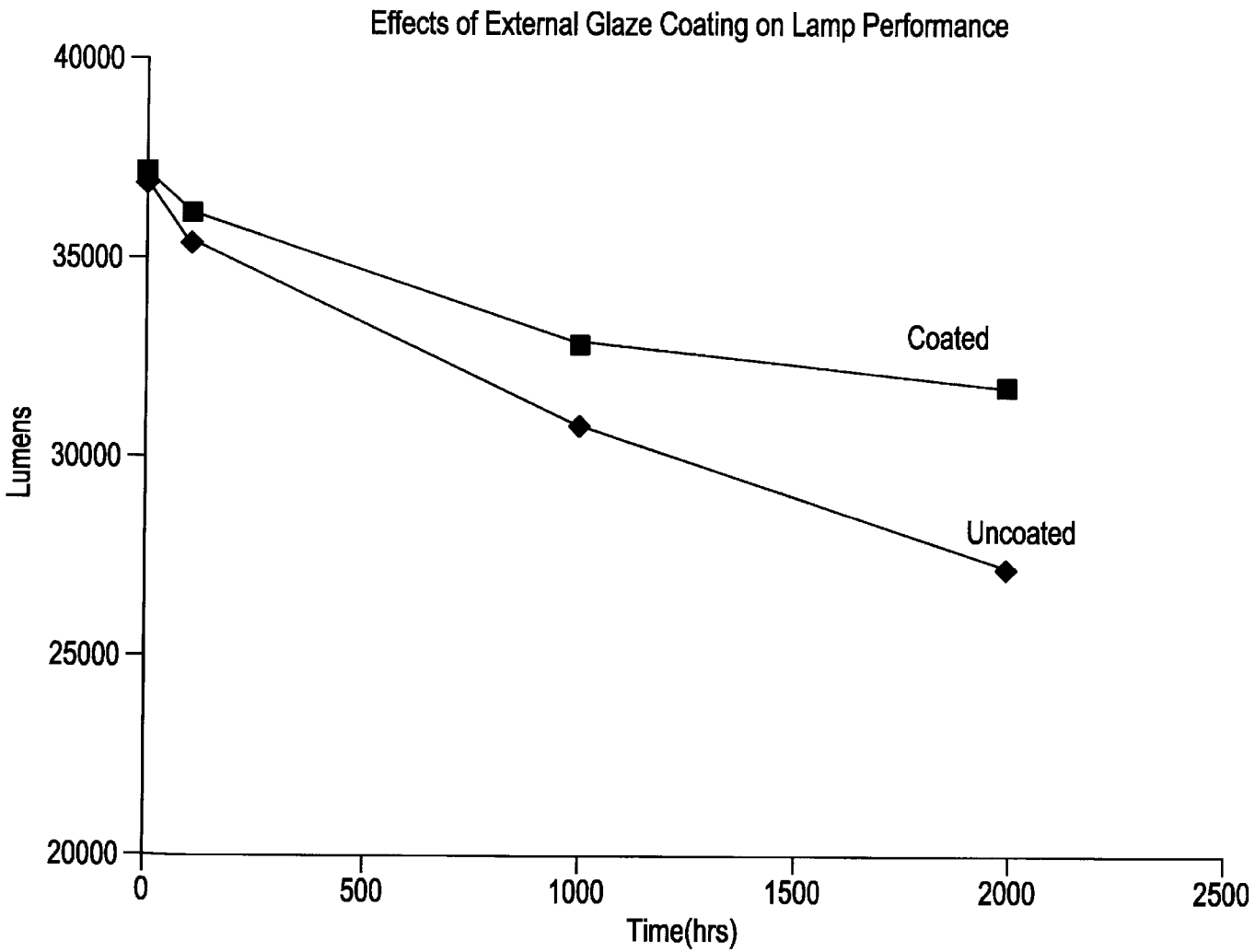
FIG. 4 is a graph which demonstrates the performance of a lamp using an external coating of the al-boro-silicate glaze as compared to an uncoated MUR400 lamp over 2000 hours.

In accordance with the present invention a high silica base glass 18 is applied as a glaze to the inner surface of arc tube 14 and is amorphous. The glaze may optionally be applied to the outside surface (FIG. 2) of the arc tube, or to both the inside and outside surfaces of the arc tube (FIG. 3). Preferably the borosilicate glaze 18 has a sufficient thickness to reduce loss of the metallic portion of the fill by diffusion of sodium and/or by reaction of the metal component and the silica of the arc tube wall, and hence reduce a corresponding buildup of free halogen. In addition, the borosilicate glaze 18 must be sufficiently thin to allow only minimal blockage of visible light output from the arc tube. Since the metallic portion of the fill generates the visible radiation during lamp operation, the useful life of the lamp is advantageously extended by reducing loss thereof. Furthermore, since a buildup of free halogen typically causes arc instability and eventual arc extinction, reducing such a buildup likewise extends the useful life of the lamp.

In a preferred embodiment of the present invention, arc tube 14 is comprised of fused silica and the borosilicate glaze contains aluminum oxide (alumina). Alumina, like boron, is a preferred material because of its capability to inhibit sodium diffusion in glass. Therefore, both are used together herein. Note, however, the previous discussion regarding coating the inside surface of the lamp with a material compatible with the lamp dose, for instance, scandium. A preferred thickness for the metal silicate coating 18 ranges between 0.5 to about 50 micrometers or greater.

The glaze can be applied to the arc tube surface by any known coating method. Preferably, the glaze is applied by a suspension or sol-gel technique. For example, the glaze can be deposited on the arc tube surface in the form of a suspension of powdered silica, $B_2O_3$ and metal oxide, such as scandium oxide, in an appropriate carrier liquid. Alternatively, the silica, boron oxide and metal oxide may be first combined to form scandium borosilicate, which is then flitted and suspended in a liquid carrier. Use of the sol-gel technique would require the preparation of a metal alkoxy composition, comprising a boron alkoxy, silica alkoxy and scandium alkoxy. This sol-gel is then deposited on the arc tube surface. These coatings are then heated to temperatures high enough to cause the powdered components to melt and flow over the arc tube surface, or to be enameled onto the arc tube surface, forming a substantially continuous glaze of borosilicate.

The "borosilicate glaze", i.e. coating, can be characterized by several techniques. After the coating material is enameled onto the arc tube surface, visually the glass is transparent. X-ray analysis of these surfaces shows only an amorphous structure indicating little or no crystalline phase. If the "enameled-on" structure was crystalline one would expect distinct X-ray diffraction patterns. The total amount of metal silicate, e.g., aluminum borosilicate, in the glassy region of the arc tube wall can be determined by dissolving the glass and measuring concentrations by techniques such as ICP (inductive coupled plasma) spectroscopy. The presence of the metal borosilicate can also be detected by using a scanning electron microscope equipped with an EDX analysis system to produce an EDX dot map of the metal borosilicate fused into the fused silica wall. Thus, the thickness of the region may be determined from edge fracture surfaces of the region using an EDX dot mapping technique, as is known in the art, or by any other suitable technique. An edge fracture of an arc tube bearing the subject metal borosilicate enamel would reveal a well defined boundary between arc tube and enamel, though both will be transparent when viewed from the surface of the arc tube. Typical thicknesses for the region were found to range from 2–30 m. Thickness will depend on the amount of initial oxide coated on the surface and fusion times/temperatures as is known in the art.

The above is intended to be illustrative, but non-limiting with respect to the practice of the invention. The invention will also be further understood by reference to the illustrative, but non-limiting example below.

EXAMPLE 1

A high silica base glass containing about 82% by weight $SiO_2$, 12% by weight $B_2O_3$ and 6% by weight $Al_2O_3$, sold commercially by General Electric, was applied to the exterior surface of a fused quartz arctubes by applying a suspension containing the fritted glaze to the arc tube, drying the coating to remove the solvent and melting the frit, thereby enameling the borosilicate-metal containing material onto the arc tube surfaces. Enameling required heating the coated arc tube to temperatures that allow the frit to melt and flow over the arc tube but are below the softening point of the fused silica arc tube.

An MUR400 watt metal halide lamp made from this external coated quartz was operated for 2000 hours and retained 17% more lumens over control lamps without the coated quartz.

EXAMPLE 2

A high silica base glass 82% by weight $SiO_2$, 12% by weight $B_2O_3$ and 6% by weight $Al_2O_3$ sold commercially by General Electric was ground into a fine powder and admixed with about 1% by weight $CeO_2$. The mix was applied to the wall of a quartz tube by applying a liquid suspension containing the fritted glaze. Enameling required heating the borosilicate cerium oxide containing frit to a temperature below the melting point of quartz to melt the doped enamel. Transmittance measurements of the glazed quartz show a reduction in transmittance at 300 nm of about 5% over standard quartz.

It is understood that various other modifications will be apparent to and can be readily made by those skilled in the art without departing from the scope and spirit of the present invention. Accordingly, it is not intended that the scope of the claims appended hereto be limited to the description set forth above but rather that the claims be construed as encompassing all of the features of patentable novelty which reside in the present invention, including all features which would be treated as equivalents thereof by those skilled in the art to which the invention pertains.

What is claimed is:

1. A high intensity discharge lamp comprising:

a light-transmissive arc tube for containing a plasma arc discharge, said arc tube comprising fused silica or fused quartz;

a fill disposed in said arc tube, said fill including at least one metal halide; and a vitreous, light-transmissive glaze disposed on at least a portion of a surface of said arc tube, said coating comprising a borosilicate containing at least one metal oxide, wherein a metal component of said metal oxide and a metal component of said at least one metal halide are the same element.

2. The high intensity lamp of claim 1 wherein said at least one metal oxide in said borosilicate coating is selected from the oxides of aluminum, scandium, yttrium, and the rare earth elements.

3. The high intensity lamp of claim 1 wherein said borosilicate coating is disposed on at least a portion of the inner surface of said arc tube.

4. The high intensity lamp of claim 1 wherein said borosilicate coating is disposed on at least a portion of the outer surface of said arc tube.

5. The high intensity lamp of claim 1 wherein said borosilicate coating is disposed on at least a portion of the inner and outer surfaces of said arc tube.

6. The high intensity lamp of claim 1 wherein said borosilicate coating contains at least one additional component selected from the group consisting of rare earth elements and transition metals which are capable of absorbing select wavelengths of light or energy emitted from said arc tube.

7. The high intensity lamp of claim 6 wherein said at least one additional component of said borosilicate coating is selected from the group consisting of titanium, ceria, cobalt, chromium, iron, and neodymium.

8. The high intensity lamp of claim 1 wherein said borosilicate coating comprises a high silica base glass in combination with an oxide of at least one metal contained in said fill.

9. The high intensity lamp of claim 5 wherein said borosilicate coating on said inner surface of said arc tube has the same composition as said borosilicate coating on said outer surface of said arc tube.

10. The high intensity lamp of claim 1 wherein said borosilicate coating comprises fused silica containing at least 95 weight % $SiO_2$.

11. The high intensity lamp of claim 1 wherein said borosilicate coating contains aluminum oxide and said coating is about 0.5 micrometers to about 50 micrometers thick.

12. A process for protecting a fused silica arc tube of a metal halide discharge lamp containing a fill including at least one metal halide, comprising:

providing at least a portion of a surface of said arc tube with a coating which is vitreous and light-transmissive, and which comprises a borosilicate containing at least one metal, said coating inhibiting the reaction of the components of said fill with the fused silica of said arc tube and further inhibiting the diffusion of the components of said fill through the fused silica of said arc tube, wherein a metal component of said metal oxide and a metal component of said at least one metal halide are the same element.

13. The process of claim 12 wherein said at least one metal in said borosilicate coating is selected from the oxides of aluminum, scandium, yttrium, and the rare earth elements.

14. The process of claim 12 wherein said borosilicate coating is provided on at least a portion of the inner surface of said arc tube.

15. The process of claim 12 wherein said borosilicate coating is provided on at least a portion of the outer surface of said arc tube.

16. The process of claim 12 wherein said borosilicate coating is provided on at least a portion of the inner and outer surfaces of said arc tube.

17. The process of claim 12 wherein said borosilicate coating contains at least one additional component selected from the group consisting of rare earth elements and transition metals which are capable of absorbing select wavelengths of light or energy emitted from said arc tube.

18. The process of claim 17 wherein said at least one additional component of said borosilicate coating is selected from the group consisting of titanium, ceria, cobalt, chromium, iron, and neodymium.

19. The process of claim 12 wherein said borosilicate coating comprises a high silica base glass in combination with an oxide of at least one metal contained in said fill, said at least one metal being capable of reaction with said fused silica of said arc tube.

20. The process of claim 12 wherein said borosilicate coating contains aluminum oxide and said coating is about 0.5 micrometers to about 50 micrometers thick.

* * * * *